US009903099B2

(12) United States Patent
Chang

(10) Patent No.: US 9,903,099 B2
(45) Date of Patent: Feb. 27, 2018

(54) APPARATUS AND METHOD FOR SELECTING SCREEN MODE

(71) Applicant: Doosan Infracore Co., Ltd., Incheon (KR)

(72) Inventor: Kyung Yul Chang, Seoul (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 0 days.

(21) Appl. No.: 15/101,412

(22) PCT Filed: Nov. 21, 2014

(86) PCT No.: PCT/KR2014/011241
§ 371 (c)(1),
(2) Date: Jun. 2, 2016

(87) PCT Pub. No.: WO2015/083963
PCT Pub. Date: Jun. 11, 2015

(65) Prior Publication Data

US 2016/0305094 A1 Oct. 20, 2016

(30) Foreign Application Priority Data

Dec. 6, 2013 (KR) ..... 10-2013-0151492

(51) Int. Cl.
*E02F 9/26* (2006.01)
*E02F 3/32* (2006.01)

(52) U.S. Cl.
CPC ..... *E02F 9/26* (2013.01); *E02F 9/264* (2013.01); *E02F 3/32* (2013.01)

(58) Field of Classification Search
CPC ..... E02F 9/26; E02F 9/264; E02F 3/32
See application file for complete search history.

(56) References Cited

U.S. PATENT DOCUMENTS

2007/0120660 A1 5/2007 Yamada et al.
2014/0111648 A1* 4/2014 Ishimoto ..... B60R 1/00 348/148

FOREIGN PATENT DOCUMENTS

JP 2005-138751 A 6/2005
JP 2010-059653 A 3/2010
KR 10-2011-0045345 A 5/2011
KR 10-2011-0067683 A 6/2011

OTHER PUBLICATIONS

International Search Report for PCT/KR2014/011241 dated Feb. 26, 2015, citing the above reference(s).
Chinese Office Action dated Mar. 22, 2017 in connection with the counterpart Chinese Patent Application No. 201480066608.2.

* cited by examiner

*Primary Examiner* — Anne M Antonucci
(74) *Attorney, Agent, or Firm* — Hauptman Ham, LLP

(57) ABSTRACT

An exemplary embodiment disclosed in the present specification relates to an apparatus and a method for selecting a screen mode for each operation mode in construction equipment. The apparatus for selecting the screen mode for each operation mode in the construction equipment provides an optimal screen which can determine an operation mode using a boom angle and a turning angle and a driving speed of an upper body, remove a blind spot according to an operation mode, and improve safety.

20 Claims, 8 Drawing Sheets

〈LEFT AND RIGHT CLOSE-UP〉 〈RIGHT UPPER PORTION〉 〈REAR SIDE〉

〈TOP VIEW〉 〈RIGHT〉 〈REAR〉

〈LEFT〉 〈TOP VIEW〉 〈REAR〉

〈BOOM CAMERA〉 〈TOP VIEW〉 〈REAR〉

(a) (b)

APPARATUS AND METHOD FOR SELECTING SCREEN MODE

CROSS REFERENCE TO RELATED APPLICATION

This application claims the priority of Korean Patent Application No. 10-2013-0151492, filed Dec. 6, 2013 in the Korean Intellectual Property Office. Further, this application is the National Phase application of International Application No. PCT/KR2014/011241 filed Nov. 21, 2014, which designates the United States and was published in Korean.

TECHNICAL FIELD

The present disclosure relates to an apparatus and a method for selecting a screen mode for each operation mode in construction equipment.

BACKGROUND ART

Generally, when construction equipment which is used for construction, such as an excavator, a wheel loader, or a fork lift, is operated, it is very important to secure a clear view not only at a front side, but also at a rear side and left and right sides.

In the construction equipment, one or more cameras are mounted in different positions. Therefore, surrounding environments are provided onto a screen provided in the excavator through video by the mounted cameras in accordance with the work, thereby securing a clear view of the operator.

However, dead zone vary depending on operations of the excavator which is classified into a digging work, a deep digging work, a rotating work, and driving. Further, at the time of the operation of the excavator, for example, during the deep digging operation, complex operations such as the rotation work and the digging work are generated. In the meantime, whenever the operation changes, there is an optimal view which may remove the dead zone and improve the safety. Therefore, in order to secure the optimal view at the time of the complex operation, the screen needs to be continuously and manually operated.

DISCLOSURE

Technical Problem

However, when a screen mode is manipulated to secure the optimal view for every operation, the work efficiency is lowered and attention of the operator is distracted, which may cause a problem of the safety.

Therefore, an exemplary embodiment of the present disclosure has been made in an effort to provide an apparatus and a method for automatically selecting and providing an optimal screen mode in accordance with a type of work using construction equipment.

Technical Solution

According to an exemplary embodiment of the present disclosure, a screen mode selecting method of a screen mode selecting apparatus includes receiving one or more working information from a sensor or an actuator, determining a working mode using the working information, searching a screen mode corresponding to a determined working mode, and selectively editing a video received from a plurality of cameras to display the image on the screen, in accordance with the searched screen mode.

After the displaying of the image on the screen, the procedure may return to the receiving of the work information.

One or more working information may include a boom angle which is an output value of an angle sensor attached to a joint of a boom, a turning RPM or a driving speed which is an output value of an angle sensor attached to a turning body.

The determining of a working modeworking mode using the working information may include a first step of determining whether the mode is a driving mode using the driving speed, a second step of checking a turning status using the turning angular velocity when it is determined that the mode is not the driving mode in the first step, a third step of checking whether the turning direction is a clockwise direction when it is determined that the mode is a turning mode in the second step to determine that the mode is a right turning mode when the turning direction is a clockwise direction and determine that the mode is a left turning mode when the turning direction is a counter clockwise direction, a step of checking whether the boom angle is within a predetermined range when it is determined that the mode is not a turning mode in the second step, and a step of determining that the mode is a flatland digging mode when the boom angle is a within a predetermined range, determining that the mode is a upper bed working modeworking mode when the boom angle exceeds a predetermined range, and determining that the mode is a deep digging mode when the boom angle is below the predetermined range.

In the selectively editing of the video received from the plurality of cameras in accordance with the searched screen mode to display the image on the screen, in accordance with the screen mode corresponding to the driving mode, images including a close-up video of the right camera, a close-up image of the left camera, a video of the front camera, and a video of the rear camera are displayed on the screen, images including a video of the right camera, a top view, and a video of the rear camera are provided onto the screen in accordance with the screen mode corresponding to the right turning mode, images including a video of the left camera, a top view, and a video of the rear camera are provided onto the screen in accordance with the screen mode corresponding to the left turning mode, images including a video of the first boom camera, a top view, and a video of the rear camera are provided onto the screen in accordance with a screen mode corresponding to the flatland digging mode, images including the video of the second boom camera, a top view, and the video of the rear camera are provided onto the screen in the deep digging mode and the upper digging mode.

According to another exemplary embodiment of the present disclosure, a screen mode selecting apparatus includes a memory unit which stores information on a screen mode corresponding to a working modeworking mode, a control unit which receives working information from a sensor or an actuator to determine a working modeworking mode, searches the screen mode corresponding to the determined working modeworking mode from a database, and controls to selectively edit a video received from the plurality of cameras in accordance with the searched screen mode to be disposed on the screen, and a display unit which displays an image which is selectively edited in accordance with a working modeworking mode and instruction of the control unit.

The working information may include a boom angle which is an output value of an angle sensor attached to a joint of a boom, a turning angular velocity or a driving speed which is an output value of an angle sensor attached to a turning body.

The control unit checks whether the driving speed is zero. When the driving speed is not zero, the control unit determines that the mode is a driving mode. When the driving speed is zero, the control unit checks whether the turning angular velocity is zero. When the turning angular velocity is not zero, the control unit checks whether a turning direction is a clockwise direction. When the turning direction is a clockwise direction, the control unit determines that the mode is a right turning mode and when the turning direction is a counterclockwise direction, the control unit determines that the mode is a left turning mode. When the driving mode is zero and the turning angular velocity is zero, the control unit checks whether a boom angle is within a predetermined range. When the boom angle is within the predetermined range, the control unit determines that the mode is a flatland digging mode. When the boom angle exceeds the predetermined range, the control unit determines that the mode is an upper digging mode. Further, when the boom angle is below the predetermined range, the control unit determines that the mode is a deep digging mode. As information on a screen mode corresponding to the working modeworking mode, the screen mode corresponding to the working modeworking mode is stored in a table, according to the table, the driving mode corresponds to a screen mode including a close-up video of the right camera, an close-up video of the left camera, a video of the front camera, and a video of the rear camera, the right turning mode corresponds to a screen mode including a video of the right camera, a top view, and a video of the rear camera, the left turning mode corresponds to a screen mode including a video of the right camera, a top view, and a video of the rear camera, the flatland digging mode corresponds to a screen mode including a video of the first boom camera, a top view, and a video of the rear camera, the deep digging mode and the upper digging mode correspond to a screen mode including a video of the second boom camera, a top view, and a video of the rear camera, and the top view is an image obtained by composing images from the plurality of front camera, a rear camera, a right camera, and a left camera to watch the vehicle through a virtual bird's eye view.

Effects

According to the exemplary embodiment suggested in this specification, the construction equipment automatically provides an optimal screen which is suitable for the type of work to the operator during the operation, thereby removing the dead zone area of the working environment of the surrounding in accordance with the type of work. Therefore, the present disclosure provides convenience to the operator and ultimately improves the safety of the works.

DETAILED DESCRIPTION OF CERTAIN INVENTIVE EMBODIMENTS

Figure 1:
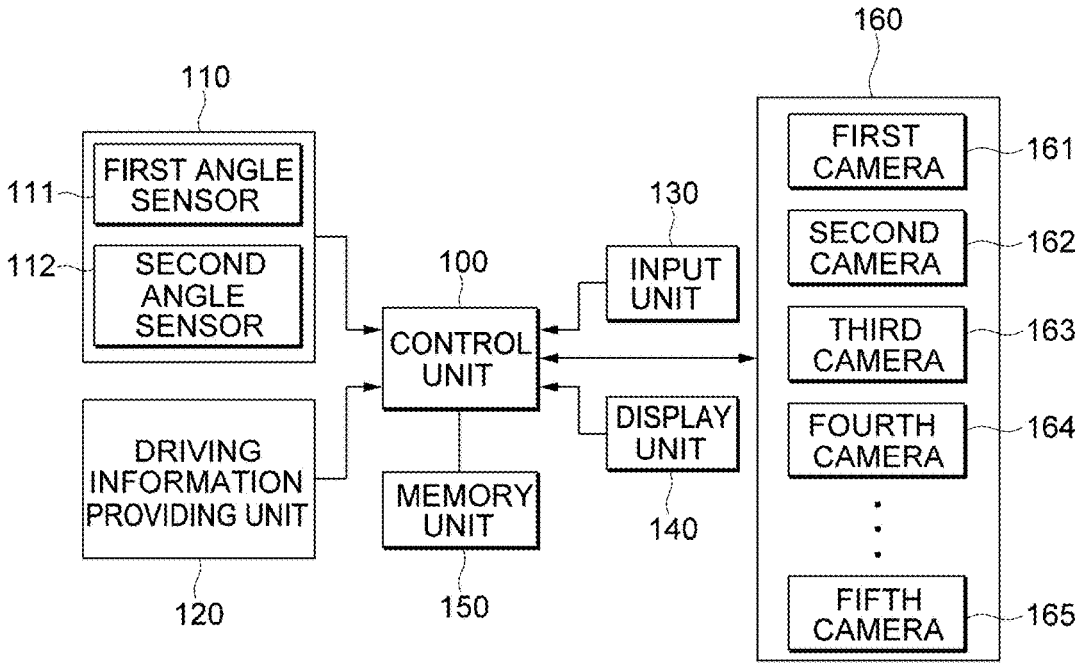
FIG. 1 is an exemplary view of the block diagram illustrating a screen mode selecting device for every working mode of an excavator according to an exemplary embodiment of the present disclosure.

Hereinafter, exemplary embodiments according to the present disclosure will be described in detail with reference to the accompanying drawings, and the same or similar components are denoted by the same reference numerals regardless of reference numerals, and repeated description thereof will be omitted.

In describing the present disclosure, when it is determined that a detailed description of a related publicly known technology may obscure the gist of the present disclosure, the detailed description thereof will be omitted. Further, it is noted that the accompanying drawings are used just for easily appreciating the spirit of the present disclosure and it should not be interpreted that the spirit of the present disclosure is limited by the accompanying drawings.

FIG. 1 is an exemplary view of the block diagram illustrating a screen mode selecting device for every working mode of an excavator according to an exemplary embodiment of the present disclosure.

As illustrated in FIG. 1, a screen mode selecting device for every working mode of an excavator according to an exemplary embodiment of the present disclosure may include a control unit 100, one or more angle sensors 110, a driving information input unit 120, an input unit 130, a display unit 140, a memory unit 150, and one or more cameras 160.

Figure 2:
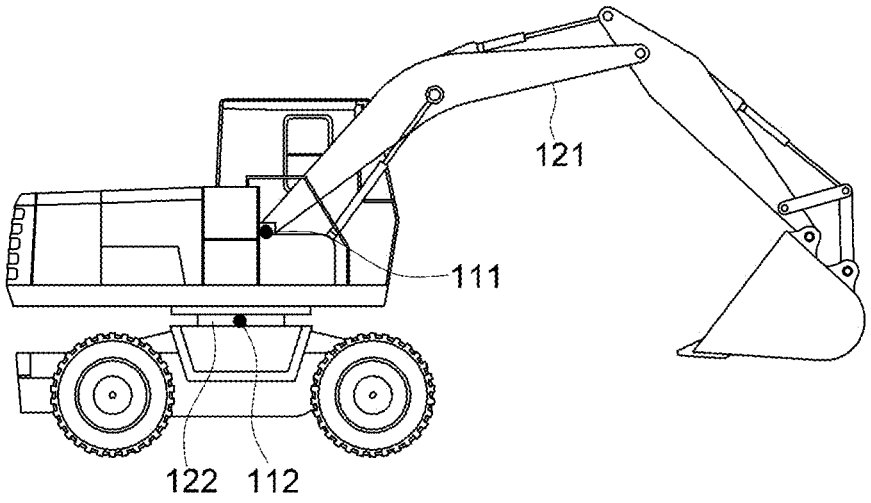
FIG. 2 is an exemplary view illustrating a position of a sensor attached onto the excavator according to an exemplary embodiment of the present disclosure.

First, the angle sensor 110 in the exemplary embodiment of the present disclosure detects a change of an angle in accordance with an operation of an attaching unit. For example, as illustrated in FIG. 2, the attaching unit refers to a position where the sensor is attached in the excavator. For example, the attaching unit may be a boom (121 in FIG. 2) and a turning body (122 in FIG. 2). For the purpose of convenience, an angle sensor which is attached to the boom 121 is referred to as a boom angle sensor 111 and an angle sensor which is attached to the turning body 122 is referred to as a turning angle sensor 112. The angle sensor 110 including the boom angle sensor 111 and the turning body 122 transmits an output signal to the control unit 100.

The driving information input unit 120 of the exemplary embodiment of the present disclosure provides driving information. The driving information is information to confirm whether the excavator is being driven and may include a driving speed and a driving direction. Information on whether the excavator is being driven (whether a driving speed is zero) may be obtained from a signal output from an actuator. For example, in the case of a crawler type, the information may be obtained from a signal output by manipulating a pedal. Further, in the case of a wheel type, the information may be obtained from a signal output by manipulating a steering wheel.

The driving speed may be obtained by a speed sensor. The speed sensor is provided in a transmission unit of a vehicle to detect an engine RPM and determine the driving speed. In addition to this, driving information may be obtained by various known methods.

The control unit 100 provides an optimal image using a video received from one or more cameras 160. For example, the control unit 100 provides an around view monitor (AVM) function, which may provide a top view of the excavator. Further, the control unit 100 may provide an enlarged image and/or a partial image of the video. Here, the around view monitor (AVM) is a function which provides 360 degree situations of front, rear, left and right sides of the vehicle through an internal monitor by a virtual bird's eye view from above the vehicle using a total of four or more cameras provided at front, rear, left, and right sides of the vehicle.

Specifically, according to the exemplary embodiment of the present disclosure, the control unit 100 determines a working mode using a signal (working information) received from the angle sensor 110 and the driving information input unit 120 and selects an optimal screen mode for every operation mode which has been stored in advance in the memory unit 150. The control unit 100 controls the video received from an arbitrary camera among a plurality of cameras to be displayed on the display unit 140 in accordance with the selected screen mode.

In the exemplary embodiment of the present disclosure, the control unit 100 checks whether the driving speed is zero. When the driving speed is not zero, the control unit 100 determines that the mode is a driving mode. Further, when the driving speed is zero, the control unit 100 checks whether the turning angular speed is zero. When the turning angular speed is not zero, the control unit 100 determines whether the turning direction is a clockwise direction. When the turning direction is a clockwise direction, the control unit 100 determines that the mode is a right turning mode. When the turning direction is a counterclockwise direction, the control unit 100 determines that the mode is a left turning mode.

When the driving speed is zero and the turning angular speed is zero, the control unit 100 checks whether the boom angle is within a predetermined range. When the boom angle is within a predetermined range, the control unit 100 determines that the mode is a flatland digging mode. When the boom angle exceeds a predetermined range, the control unit 100 determines that the mode is an upper bed working mode. When the boom angle is below a predetermined range, the control unit 100 determines that the mode is a deep digging mode.

When a signal $S_{on}$ or $S_{off}$ for instruction to turn on or turn off an automatic screen switching function is input from the operator, the input unit 130 transmits the signal $S_{on}$ or $S_{off}$ to the control unit 100. The input unit 130 may be implemented by various input units which are currently commercially applied or will be commercially applied in the future. The input unit 130 may include not only a general input device such as a keyboard, a mouse, a joy stick, a touch screen, or a touch pad but also a gesture input unit which detects a motion of the user to generate a specific input signal.

The display unit 140 displays a video corresponding to the screen mode in accordance with the indication of the control unit 100. For example, as illustrated in FIGS. 6 to 9, the display unit 140 may visually display a video received from an arbitrary camera selected from among a plurality of cameras in accordance with each screen mode or an edited image on the screen.

The memory unit 150 stores information required for the screen mode selecting method for every working mode of the construction equipment. Specifically, in the present disclosure, the memory unit 150 may store a table in which a working mode and an optimal screen mode are associated with each other to provide an optimal screen for the work. Table 1 shows an example of a matching table.

TABLE 1

| Driving speed $V_X$ | Turning angle $_X$ | Boom angle $_Y$ | Working mode | Screen mode |
|---|---|---|---|---|
| $V_X = 0$ | $_X = 0$ | $-20_Y20$ | General flatland digging | B1<br>TOP VIEW<br>r1 |
| $V_X = 0$ | $_X = 0$ | $_Y-20$<br>$_Y20$ | Deep digging<br>Upper work | B2<br>TOP VIEW<br>r1 |
| $V_X = 0$ | $_X0$ (right turning) | — | Right turning | TOP VIEW<br>R<br>r1 |
| $V_X = 0$ | $_X0$ (left turning) | — | Left turning | TOP VIEW<br>L<br>r1 |
| $V_X0$ | — | — | Driving | R (close-up)<br>L(close-up)<br>F<br>r1 |

In Table 1, R denotes an image of a right camera and L denotes an image of a left camera, B1 denotes an image of a first boom camera, and B2 denotes an image of a second boom camera. r1 denotes an image of a rear camera and F denotes a front camera. Further, close-up denotes an image enlarged with respect to a body of the vehicle.

Figure 6:
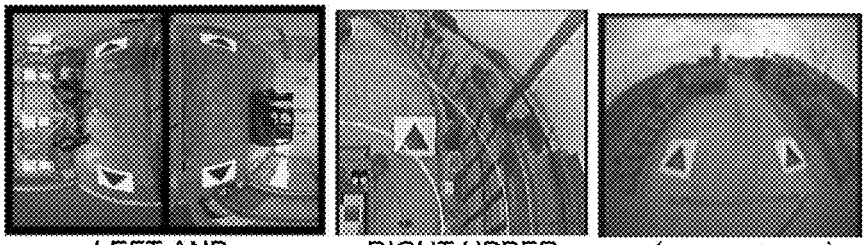
FIGS. 6 to 9 are screens illustrating a provided screen optimized in accordance with a screen mode according to an exemplary embodiment of the present disclosure.
Figure 7:
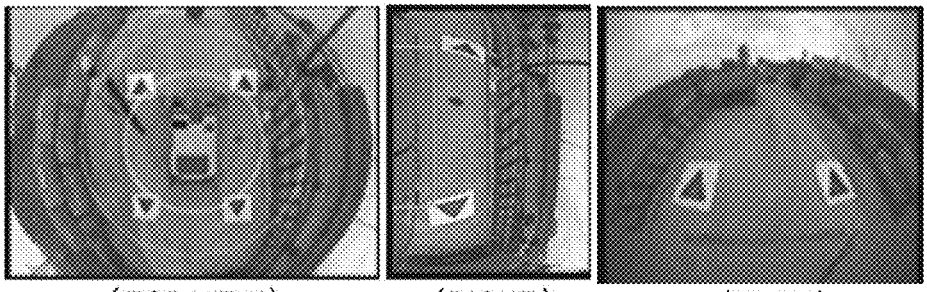
Figure 8:
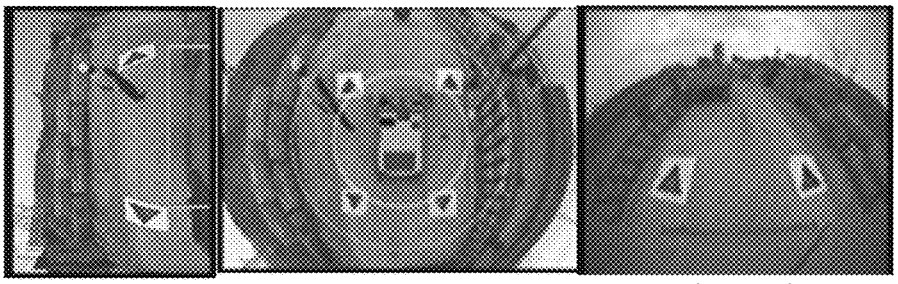
Figure 9:
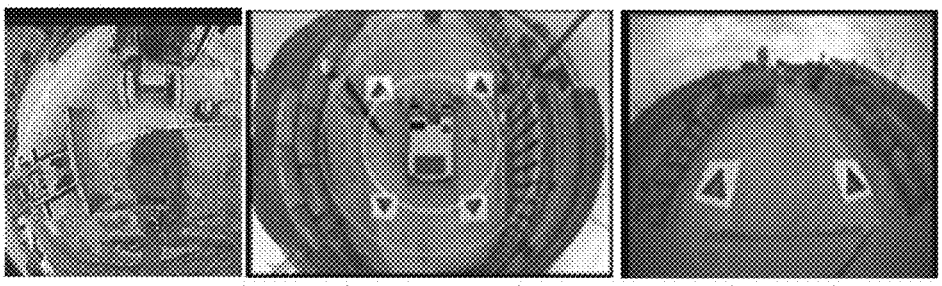

An example of a screen which is provided for every screen mode in Table 1 is illustrated in FIGS. 6 to 9. FIG. 6 is an example of a screen mode displayed when an operating mode is a driving mode and FIG. 7 is an example of a screen mode displayed when an operating mode is a right turning mode. FIG. 8 is an example of a screen mode displayed when an operating mode is a left turning mode and FIG. 9 is an example of a screen mode displayed when an operating mode is a digging mode.

The memory unit 150 includes a magnetic media such as a hard disk, a floppy disk, and a magnetic tape, an optical media such as a compact disk read only memory (CD-ROM) or a digital video disk (DVD), a magneto-optical media such as a floptical disk, a ROM, a random access memory (RAM), and a flash memory.

One or more cameras 160 are provided to take an video and transmit the video to the control unit 100.

Figure 3:
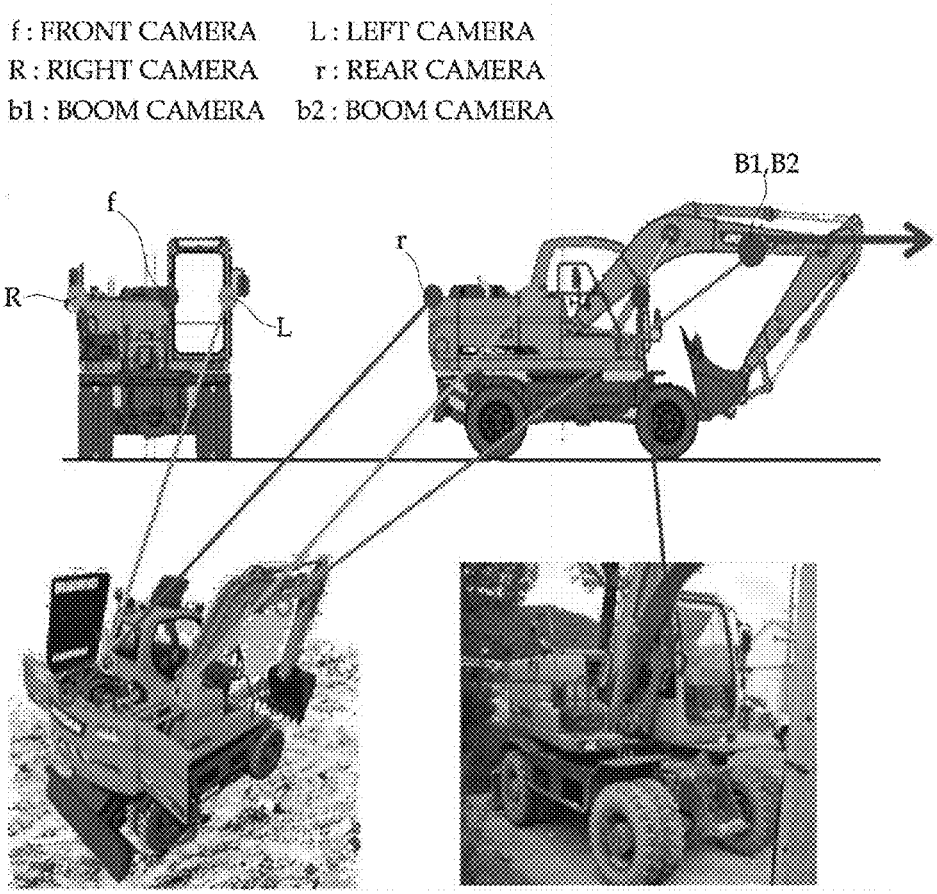
FIG. 3 is an exemplary view illustrating a position of a camera mounted in the excavator according to an exemplary embodiment of the present disclosure.
Figure 10:
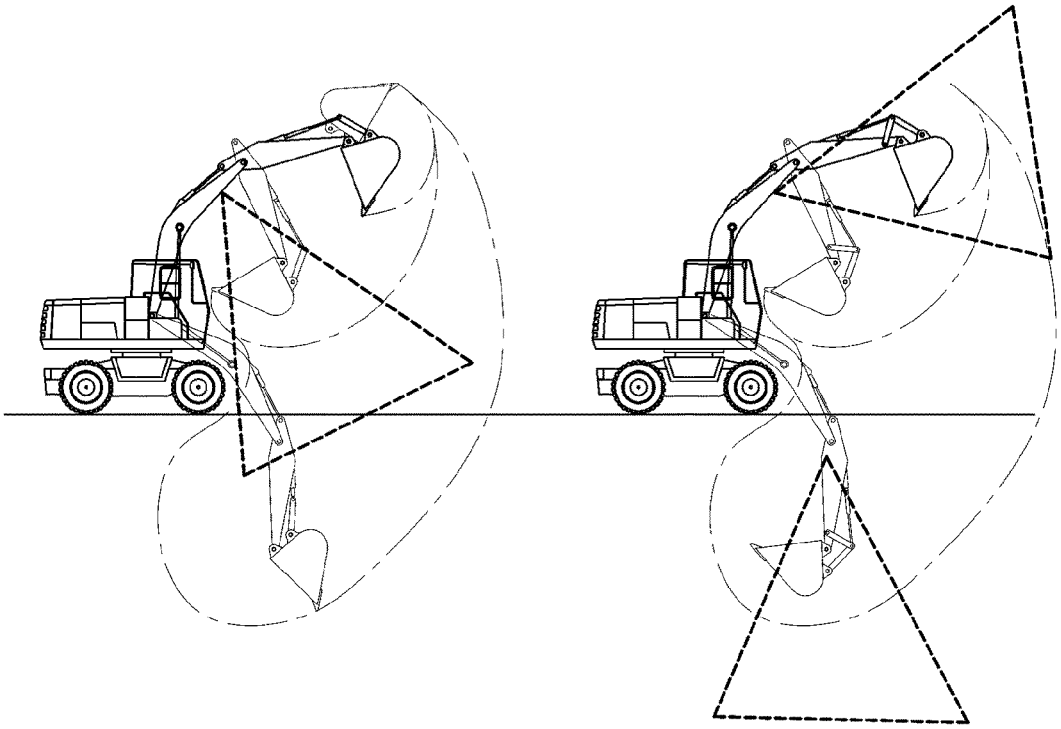
FIG. 10 is an exemplary view illustrating an angle of view of a boom camera provided in an excavator according to an exemplary embodiment of the present disclosure.

The camera 130 according to an exemplary embodiment of the present disclosure, as illustrated in FIG. 3, may include a left camera L attached to a left side of the upper body of the vehicle, a right camera R which is attached to a right side of the upper body of the vehicle, a front camera F attached on the front of the upper body of the vehicle, a rear camera r attached at a rear side of the upper body of the vehicle, and two boom cameras B1 and B2. This is merely an example, but different numbers of cameras may be attached to different positions in accordance with a model of the excavator. Referring to FIG. 10, angles of view of two boom cameras B1 and B2 may be checked. As illustrated in portions (a) and (b) of FIG. 10, the angles of view of the boom cameras B1 and B2 are different from each other. Therefore, different cameras may provide an optimal image in accordance with the work. For example, the boom camera B1 provided as illustrated in portion (a) of FIG. 10 is suitable for flatland digging. Further, the boom camera B2 provided as illustrated in portion (b) of FIG. 10 may be suitable for a deep digging or upper digging work.

Not all the above described components are necessary, but some of the components may be omitted.

Figure 4:
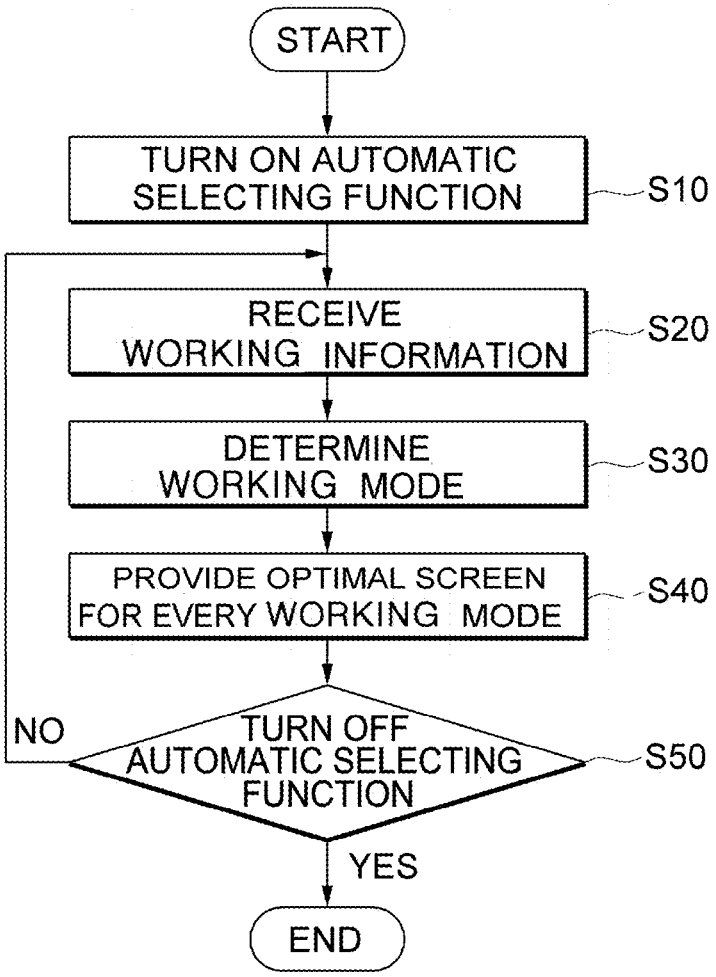
FIG. 4 is a flow chart illustrating a screen mode selecting method for every working mode of an excavator according to an exemplary embodiment of the present disclosure.

Now, the screen mode selecting method for every working mode in the screen mode selecting apparatus for every working mode of the construction equipment configured as described will be described in detail with reference to FIGS. 4 to 5.

First, an instruction signal to start an automatic screen mode selecting function for every working mode is input through an input unit in step S10.

When the instruction signal is input, in order to automatically select the screen mode, one or more input information, for example, an angle value and driving information from the angle sensor are provided in step S20.

The working mode is determined using the angle value and the driving information in step S30. A method for determining a working mode will be described with reference to FIG. 5.

Figure 5:
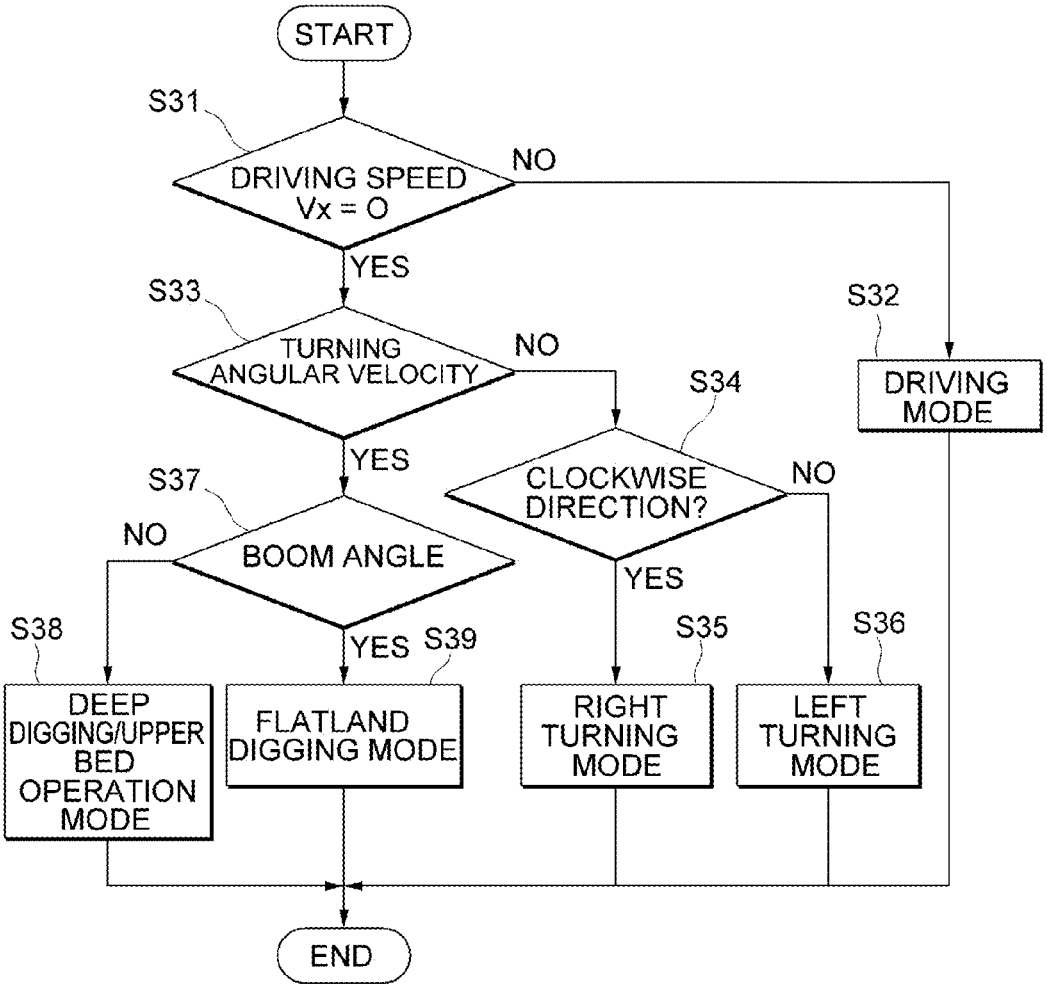
FIG. 5 is a flow chart illustrating a working mode determining method of an excavator according to an exemplary embodiment of the present disclosure.

As illustrated in FIG. 5, it is checked whether the driving speed Vx is zero using input driving information in step S31. When the driving speed is not zero, it is determined that the mode is a driving mode in step S32.

When the driving speed is zero in step S31, it is checked whether a turning angular velocity x among the input angle values is zero in step S33.

When the turning angular velocity x is not zero, it is checked whether the turning angular velocity x is larger than zero in step S34. When an arbitrary reference position is zero, it is determined that the turning angular velocity x of a right direction from the reference position is positive and the turning angular velocity x of the left direction angle is negative.

When the turning angular velocity x is larger than zero, it is determined that the mode is a right turning mode in step S35. When the turning angular velocity x is not zero, but is not larger than zero, that is, smaller than zero, it is determined that the mode is the left turning mode in step S36.

In step S33, when the turning angular velocity x is zero, it is checked whether the boom angle $_Y$ is within a range of −20 degrees to +20 degrees in step S37. When the boom angle y is smaller than −20, it is determined that the mode is a deep digging mode. When the boom angle y is larger than +20 degrees, it is determined that the mode is a upper bed working mode in step S38. In the exemplary embodiment of the present disclosure, the deep digging mode and the upper bed working mode provide the same screen mode. However, in another modified example, the deep digging mode and the upper bed working mode may provide different screen modes.

When the boom angle y is within a range of −20 degrees to +20 degrees in step S37, it is determined that the mode is a flatland digging mode in step S39.

An optimal screen corresponding to a working mode determined in accordance with the determined working mode is provided in step S40. According to the exemplary embodiment of the present disclosure, the optimal screen mode required for the working mode is searched from the table which is already stored in a database, as illustrated in FIG. 1. The videos received from the plurality of cameras are selected in accordance with the searched screen mode to display the image on the screen.

For example, in accordance with the screen mode corresponding to the driving mode, images including a close-up video of the right camera, a close-up video of the left camera, a video of the front camera, and a video of the rear camera are displayed on the screen.

Images including the video of the right camera, a top view, and the video of the rear camera are displayed on the screen in accordance with a screen mode corresponding to the right turning mode. Further, images including the video of the left camera, a top view, and the video of the rear camera are displayed on the screen in accordance with a screen mode corresponding to the left turning mode.

Images including the video of the first boom camera, a top view, and the video of the rear camera are displayed on the screen in accordance with a screen mode corresponding to the flatland digging mode.

Images including the video of the second boom camera, a top view, and the video of the rear camera are displayed on the screen in the deep digging mode and the upper digging mode.

These are examples, but an image of the specific camera may be added to or removed from the optimal image screen for every working mode by the operator or the manager.

First, when a signal to finish the automatic screen mode selecting function for every working mode is input through the input unit, the automatic selecting functions ends. Otherwise, the process returns to step S20.

Not all the illustrated steps are necessary, but some of the steps may be omitted.

The above-described method may be implemented through various methods. For example, the exemplary embodiments of the present disclosure may be implemented by a hardware, a firm ware, a software, and a combination thereof.

When the exemplary embodiment is implemented by the hardware, the method according to the exemplary embodiment of the present disclosure may be implemented by one or more application specific integrated circuits (ASICs), digital signal processors (DSPs), digital signal processing devices (DSPDs), programmable logic devices (PLDs), field programmable gate arrays (FPGAs), a processor, a controller, a microcontroller, or a microprocessor.

When the exemplary embodiment is implemented by the firmware or the software, the method according to the exemplary embodiment of the present disclosure may be implemented by a module, a procedure, or a function which performs a function or operations described above. The software code is stored in the memory unit to be driven by the processor. The memory unit is located inside or outside the processor and exchanges data with the processor, by various known units.

Exemplary embodiments disclosed in the specification have been described above with reference to the accompanying drawings. However, the exemplary embodiments illustrated in drawing are not restrictively interpreted but may be interpreted such that the exemplary embodiments may be combined by those skilled in the art and if the exemplary embodiments are combined, some constituent elements may be omitted.

Therefore, the embodiments disclosed in the specification and the configurations illustrated in the drawings are just exemplary embodiments of the present disclosure and do not fully represent the technical spirit described in this specification. Therefore, it should be appreciated that various equivalents and modified examples capable of substituting them can be made.

INDUSTRIAL APPLICABILITY

The present disclosure is a technology which automatically provides an optimal viewing angle in accordance with the type of work, so that convenience and safety are secured for an operator. Therefore, the present disclosure has a sufficient business potential and is actually and apparently applicable so that the present disclosure has an industrial applicability.

The invention claimed is:

1. A screen mode selecting method of a screen mode selecting apparatus including one or more application specific integrated circuits (ASICs) or a processor, the ASICs or the processor to execute the method comprising:

receiving one or more working information from a sensor or an actuator;

determining a working mode using the working information;

searching a screen mode corresponding to a determined working mode; and selectively editing videos received from a plurality of cameras in accordance with the searched screen mode and displaying the image on the screen, wherein the plurality of cameras include a right camera, a left camera and a rear camera, and the rear camera is attached at a rear side of the upper body of the vehicle, wherein the videos includes the video of the right camera, the video of the left camera, the video of the rear camera and a top view of the vehicle, wherein the top view is an image obtained by composing videos from the rear camera, the right camera, and the left camera to watch the vehicle through a virtual bird's eye view, wherein the screen displays the video of the rear camera and at least one video corresponding to the working mode among the video of the left side, video of the right side and the top view of the vehicle.

2. The method of claim 1, wherein the working information includes a boom angle which is an output value of an angle sensor attached to a joint of a boom, a turning angular velocity which is an output value of an angle sensor attached to a turning body or a driving speed.

3. The method of claim 2, wherein the determining of a working mode using the working information includes:

a first step of determining whether the mode is a driving mode using the driving speed;

a second step of checking a turning status using the turning angular velocity when it is determined that the mode is not the driving mode in the first step;

a third step of checking whether the turning direction is a clockwise direction when it is determined that the mode is a turning mode in the second step to determine that the mode is a right turning mode when the turning direction is a clockwise direction and determine that the mode is a left turning mode when the turning direction is a counter clockwise direction;

a fourth step of checking whether the boom angle is within a predetermined range when it is determined that the mode is not a turning mode in the second step; and a step of determining that the mode is a flatland digging mode when the boom angle is a within a predetermined range in the fourth step, determining that the mode is a upper bed working mode when the boom angle exceeds a predetermined range, and determining that the mode is a deep digging mode when the boom angle is below the predetermined range.

4. The method of claim 3, wherein the plurality of cameras include the front camera attached on the front of the vehicle, a first boom camera and a second boom camera attached on the boom of the vehicle, wherein in the selectively editing of the video received from the plurality of cameras in accordance with the searched screen mode to display the image on the screen, in accordance with the screen mode corresponding to the driving mode, images including a close-up video of the right camera, a close-up video of the left camera, a video of the front camera, and a video of the rear camera are displayed on the screen, images including a video of the right camera, a top view, and a video of the rear camera are displayed on the screen in accordance with the screen mode corresponding to the right turning mode, images including a video of the left camera, a top view, and a video of the rear camera are displayed on the screen in accordance with the screen mode corresponding to the left turning mode, images including a video of the first boom camera, a top view, and a video of the rear camera are displayed on the screen in accordance with a screen mode corresponding to the flatland digging mode, and images including the video of the second boom camera, a top view, and the video of the rear camera are displayed on the screen in the deep digging mode and the upper digging mode.

5. A screen mode selecting apparatus, the apparatus comprising: a memory unit, implemented by one or more application specific integrated circuits (ASICs) or a processor, configured to store information on a screen mode corresponding to a working mode;

a control unit, implemented by one or more application specific integrated circuits (ASICs) or a processor, configured to receive working information from a sensor or an actuator, determine a working mode using the working information, searches the screen mode corresponding to the determined working mode from a database, and control to selectively edit a video received from the plurality of cameras in accordance with the searched screen mode to be disposed on the screen; and a display unit, implemented by one or more application specific integrated circuits (ASICs) or a processor, configured to display an image which is selectively edited in accordance with a working mode and instruction of the control unit, wherein the plurality of cameras include a right camera, a left camera, a rear camera, and one or more boom cameras, wherein the videos includes the video of one of one or more the boom cameras and a top view of the vehicle, wherein the top view is an image obtained by composing images videos from the rear camera, the right camera, and the left camera to watch the vehicle through a virtual bird's eye view, when it is determined that the working mode is a digging mode, the image including the videos of boom cameras and the top view is displayed on the screen.

6. The apparatus of claim 5, wherein the working information includes a boom angle which is an output value of an angle sensor attached to a joint of a boom, a turning angular velocity which is an output value of an angle sensor attached to a turning body or a driving speed.

7. The apparatus of claim 6, wherein the control unit determines a driving mode using the driving speed, when it is determined that the mode is not a driving mode, checks a turning status by using a turning angular velocity, when the mode is a turning status, checks whether the turning direction is a clockwise direction, when the turning direction is a clockwise direction, determines that the mode is a right turning mode, and when the turning direction is a counter clockwise direction, determines that the mode is a left turning mode, when it is determined that the mode is not the driving mode and is not a turning status, checks whether the boom angle is within a predetermined range, when the boom angle is within a predetermined range, determines that the mode is a flatland digging mode, when the boom angle exceeds a predetermined range, determines that the mode is the upper digging mode, and when the boom angle is below the predetermined range, determines that the mode is a deep digging mode.

8. The apparatus of claim 7, wherein the plurality of cameras further include a front camera and the front camera is attached at front of the vehicle, wherein as information on a screen mode corresponding to the working mode, the screen mode corresponding to the working mode is stored in a table, according to the table, the driving mode corresponds to a screen mode including a close-up video of the right camera, an close-up video of the left camera, a video of the front camera, and a video of the rear camera, and the top view is an image obtained by composing images from the front camera, the rear camera, the right camera, and the left camera to watch the vehicle through a virtual bird's eye view.

9. The apparatus of claim 7, wherein as information on a screen mode corresponding to the working mode, the screen mode corresponding to the working mode is stored in a table, according to the table, the right turning mode corresponds to a screen mode including a video of the right camera, a top view, and a video of the rear camera, the left turning mode corresponds to a screen mode including a video of the right camera, a top view, and a video of the rear camera.

10. The apparatus of claim 7, wherein as information on a screen mode corresponding to the working mode, the screen mode corresponding to the working mode is stored in a table, according to the table, the right turning mode corresponds to a screen mode including a video of the right camera, a top view, and a video of the rear camera.

11. The apparatus of claim 10, wherein the rear camera is attached at rear of the vehicle, and when it is determined that the working mode is a digging mode, the display unit further displays the video of rear side.

12. The apparatus of claim 7, the one or more boom cameras include a first boom camera, wherein as information on a screen mode corresponding to the working mode, the screen mode corresponding to the working mode is stored in a table, according to the table, the flatland digging mode corresponds to a screen mode including a video of the first boom camera, a top view, and a video of the rear camera.

13. The apparatus of claim 7, the one or more boom cameras include a second boom camera, wherein as information on a screen mode corresponding to the working mode, the screen mode corresponding to the working mode is stored in a table, according to the table, the deep digging mode and the upper digging mode correspond to a screen mode including a video of the second boom camera, a top view, and a video of the rear camera.

14. The apparatus of claim 13, the one or more boom cameras further include a first boom camera having an angle of view different from that of the second camera, wherein as information on a screen mode corresponding to the working mode, the screen mode corresponding to the working mode is stored in a table, according to the table, the flatland digging mode corresponds to a screen mode including a video of the first boom camera, a top view, and a video of the rear camera.

15. The apparatus of claim 14, wherein the rear camera is attached at rear of the vehicle, and when it is determined that the working mode is a digging mode, the display unit further displays the video of rear side.

16. The method of claim 5, wherein the rear camera is attached at a rear side of the upper body of the vehicle and generates a video of rear side, and when it is determined that the working mode is a digging mode, the display unit further displays the video of rear side.

17. The apparatus of claim 5, wherein the plurality of cameras further include a front camera and the front camera is attached at front of the vehicle, and the top view is an image obtained by composing images from the front camera, the rear camera, the right camera, and the left camera to watch the vehicle through a virtual bird's eye view.

18. A screen mode selecting method of a screen mode selecting apparatus including one or more application specific integrated circuits (ASICs) or a processor, the ASICs or the processor to execute the method comprising:

receiving one or more working information from a sensor or an actuator;

determining a working mode using the working information;

searching a screen mode corresponding to a determined working mode; and selectively editing videos received from a plurality of cameras in accordance with the searched screen mode and displaying the image on the screen, wherein the plurality of cameras include a right camera, a left camera, a rear camera, and one or more boom cameras, wherein the videos includes the videos of one of the one or more boom cameras and a top view of the vehicle, wherein the top view is an image obtained by composing videos from the rear camera, the right camera, and the left camera to watch the vehicle through a virtual bird's eye view, when it is determined that the working mode is a digging mode, the image including the videos of boom cameras and the top view is displayed on the screen.

19. The method of claim 18, Wherein the rear camera is attached at a rear side of the upper body of the vehicle and generates a video of rear side, when it is determined that the working mode is a digging mode, the image further includes the video of rear side.

20. The method of claim 19, wherein the one or more boom cameras includes a first boom camera and a second boom camera, the angles of view of the first boom camera and the angles of view of the second boom camera are different from each other, when the digging mode is the deep digging mode or the upper digging mode, the image further including the video of the first boom camera, when the digging mode is flatland digging mode, the image further including the video of the first boom camera.

* * * * *